US008242392B1

(12) United States Patent
Ondracek

(10) Patent No.: US 8,242,392 B1
(45) Date of Patent: Aug. 14, 2012

(54) MULTI-DIRECTIONAL MOMENTUM-CHANGE SENSOR AND METHODS OF USE

(76) Inventor: John Ondracek, Denver, CO (US)

( * ) Notice: Subject to any disclaimer, the term of this patent is extended or adjusted under 35 U.S.C. 154(b) by 0 days.

(21) Appl. No.: 13/286,628

(22) Filed: Nov. 1, 2011

(51) Int. Cl.
*H01H 35/14* (2006.01)

(52) U.S. Cl. ..... 200/61.45 R; 200/61.48; 200/61.49; 200/61.51; 200/61.53

(58) Field of Classification Search 200/61.45 R–61.53; 73/488, 504.02–504.04, 504.12, 504.13, 73/514.01, 514.02, 514.04, 514.15–514.19, 73/514.35, 514.37, 514.38, 535, 536, 550
See application file for complete search history.

(56) References Cited

U.S. PATENT DOCUMENTS

| | | | | |
|---|---|---|---|---|
| 2,915,604 | A * | 12/1959 | Rabinow et al. | 200/61.45 R |
| 3,175,058 | A * | 3/1965 | Swinehart et al. | 200/61.45 R |
| 3,592,156 | A | 7/1971 | Prachar | |
| 3,625,178 | A | 12/1971 | Prachar | |
| 3,631,804 | A | 1/1972 | Anderson | |
| 3,639,710 | A | 2/1972 | Haruna | |
| 3,644,690 | A | 2/1972 | Panettieri | |
| 3,685,452 | A | 8/1972 | Held | |
| 3,781,496 | A | 12/1973 | Jones | |
| 3,818,160 | A | 6/1974 | Hitchcock | |
| 3,832,507 | A | 8/1974 | Marquardt | |
| 3,835,273 | A | 9/1974 | Stolarik | |
| 3,927,286 | A | 12/1975 | Fohl | |
| 4,060,004 | A | 11/1977 | Scholz | |
| 4,081,052 | A | 3/1978 | Scharer | |
| 4,209,185 | A | 6/1980 | St. Clair | |
| 4,210,789 | A | 7/1980 | Ushiku | |
| 4,284,863 | A | 8/1981 | Breed | |
| 4,594,485 | A | 6/1986 | Brown | |
| 5,008,501 | A * | 4/1991 | Kumita et al. | 200/61.45 R |
| 5,233,141 | A | 8/1993 | Breed | |
| 5,398,965 | A | 3/1995 | Giurlando | |
| 5,609,357 | A * | 3/1997 | Amano | 280/734 |
| 5,623,246 | A | 4/1997 | Kruse | |
| 5,625,145 | A * | 4/1997 | Maeno et al. | 73/504.12 |
| 5,756,948 | A | 5/1998 | Husby | |
| 5,821,851 | A * | 10/1998 | Blackmer | 340/467 |
| 5,893,584 | A | 4/1999 | Welz | |
| 5,898,144 | A * | 4/1999 | Sakai et al. | 200/61.45 R |
| 6,424,256 | B1 | 7/2002 | Ryder | |
| 6,642,461 | B2 * | 11/2003 | Imoto | 200/61.45 R |
| 6,860,509 | B2 | 3/2005 | Xu | |
| 6,987,460 | B2 * | 1/2006 | Tews et al. | 340/689 |
| 7,235,749 | B2 * | 6/2007 | Imoto | 200/61.45 R |
| 7,330,106 | B2 * | 2/2008 | Paulson et al. | 340/467 |
| 7,450,332 | B2 | 11/2008 | Pasolini | |
| 7,481,453 | B2 | 1/2009 | Breed | |
| 7,527,288 | B2 | 5/2009 | Breed | |
| 7,629,545 | B1 | 12/2009 | Asner | |
| 7,692,110 | B2 | 4/2010 | Hong | |
| 2008/0017486 | A1 | 1/2008 | Tay | |
| 2009/0139330 | A1 | 6/2009 | Pavelescu | |
| 2010/0059345 | A1 | 3/2010 | Blank | |
| 2010/0132577 | A1 | 6/2010 | Rastegar | |

* cited by examiner

*Primary Examiner* — Michael Friedhofer
(74) *Attorney, Agent, or Firm* — Leyendecker and Lemire, LLC

(57) ABSTRACT

What is disclosed is a multi-directional momentum-change sensor, adaptable to a variety of practical applications, including, but not limited to, its use as a collision-detector for automatic passenger-safety airbag deployment systems in a motor vehicle. In one embodiment, the sensor is an electromechanical switch having a pivotable boom assembly that is responsive to sudden changes to forward and lateral momentum that exceeds a predetermined threshold. The pivotable boom assembly is able to close electrical circuits to external circuitry that pertain to the position of the boom member in order to allow for the sensing of collisions along different vectors and facilitate safety responses, such as the deployment of automobile passenger-safety airbags.

20 Claims, 3 Drawing Sheets

MULTI-DIRECTIONAL MOMENTUM-CHANGE SENSOR AND METHODS OF USE

BACKGROUND

Automobile-based collision airbags are designed to deploy in frontal and near-frontal collisions more severe than a threshold defined by the regulations governing vehicle construction in whatever particular market the vehicle is intended for. For example, United States government regulations require deployment in crashes at least equivalent in deceleration to a 23 km/h (14 mph) barrier collision, or similarly, striking a parked car of similar size across the full front of each vehicle at about twice the speed. However, many international regulations are performance based, rather than technology-based, so airbag deployment threshold is a function of overall vehicle design.

Most people are familiar with crash tests associated with direct frontal collisions. However, unlike crash tests into barriers, real-world crashes typically occur at angles other than directly into the front of the vehicle, and the crash forces usually are not evenly distributed across the front of the vehicle. Consequently, the relative speed between a striking and struck vehicle required to deploy the airbag in a real-world crash can be much higher than an equivalent barrier crash. Many sensors used in airbag systems employ a plurality of MEMS accelerometers, which are small integrated circuits with integrated micro mechanical elements that are responsive to rapid deceleration. In earlier airbag systems, some attempts were made to use mercury switches, without much success. In other early systems, a plurality of mechanical "rolamite" devices, which are low-friction rollers suspended in a tensioned band, were used to detect sudden changes in momentum along predetermined axes.

In the case of systems using macro-mechanical sensors, it would be advantageous to have a single sensor device that can effectively detect sudden changes in momentum that exceed a predetermined threshold over multiple axes, and as a result facilitate external electrical signals that can be converted into practical uses, such as the strategic automatic deployment of automobile air bags.

DETAILED DESCRIPTION

Overview

Figure 1A:
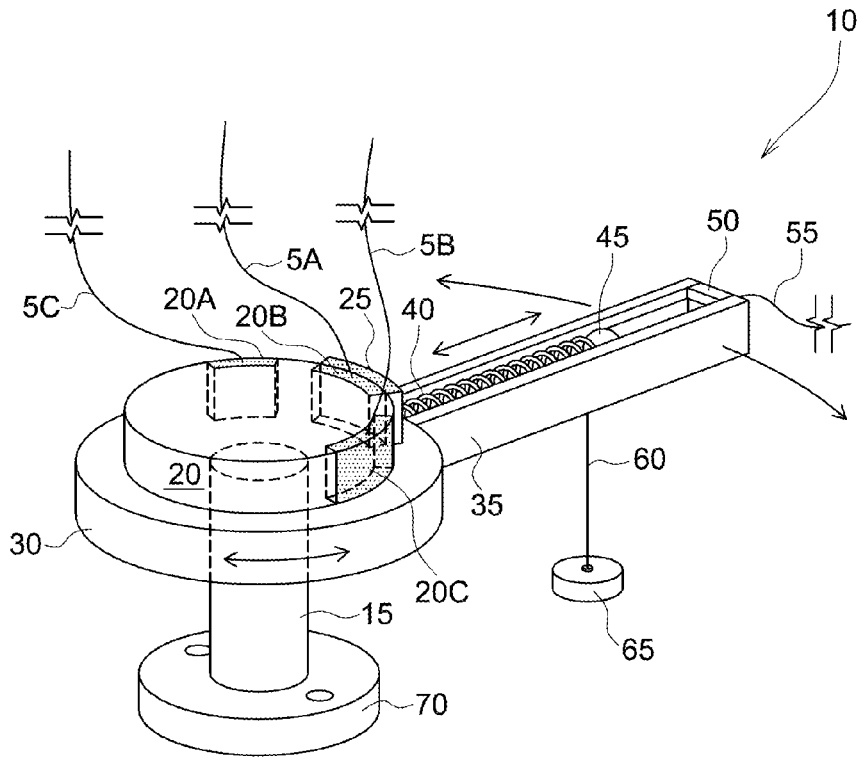
FIG. 1A depicts one embodiment of an isometric view of a multi-directional momentum-change sensor.
Figure 1B:
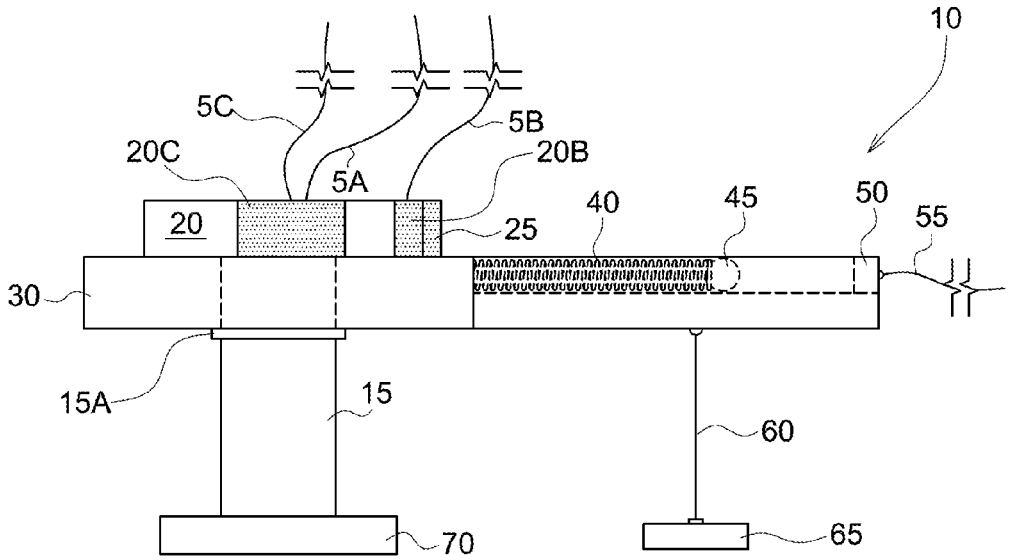
FIG. 1B depicts one embodiment of a side view of a multi-directional momentum-change sensor.
Figure 1C:
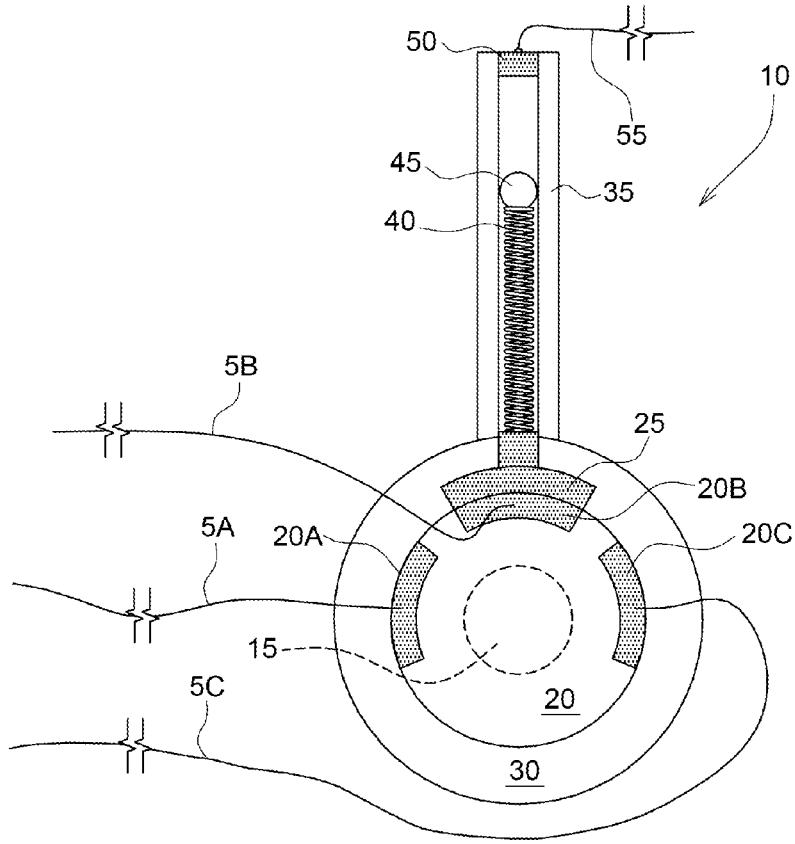
FIG. 1C depicts one embodiment of a top view of a multi-directional momentum-change sensor.
Figure 1D:
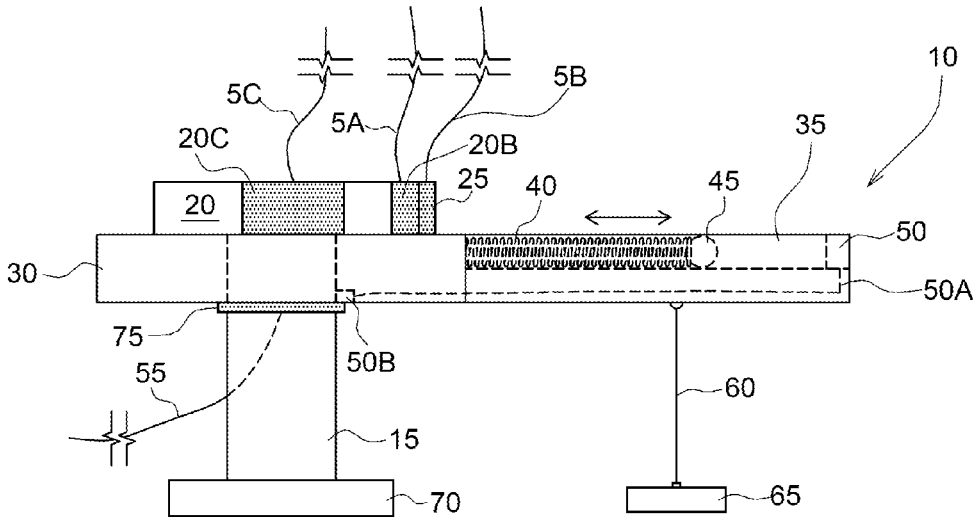
FIG. 1D depicts a second embodiment of a side view of a multi-directional momentum-change sensor, which depicts an alternate means for electrically coupling to the distal end of the pivotable boom member by employing a slip-ring type of electrical contact disposed about the column member.

The present inventive concept is generally directed to a multi-directional momentum-change sensor, adaptable to a variety of practical applications, including, but not limited to, its use as a collision-detector for automatic passenger-safety airbag deployment systems in a motor vehicle.

In one embodiment, the sensor is an electro-mechanical switch comprised of a fixedly mounted based member coupled to a column member, wherein the fixed mounting is typically on a substantially horizontal surface in a motor vehicle relative to the ground. The column member is in turn coupled on its other end to a substantially disc-shaped electrical-contact-array assembly. The electrical-contact-array assembly has a plurality of electrical-contact surfaces disposed radially about the outer surface of the substantially disc shape. In this embodiment, a key feature is an inertial switching assembly adapted to rotatably pivot about the electrical-contact-array assembly when a certain lateral force above a predetermined threshold is exceeded.

In addition, this inertial switching assembly is adapted to detect a sudden frontal deceleration (e.g., a frontal collision by a motor vehicle), and can in fact detect an oblique directional force (that is, simultaneously detect sudden lateral and frontal acceleration/deceleration forces) over a certain threshold. The various electrical contacts within the sensor are adapted, in many variations, to close and complete circuit paths that correspond to the sudden directional momentum changes, wherein the completed circuit paths can be used by external electronic circuitry/logic for various practical applications, such as the automatic deployment of motor-vehicle passenger-safety airbags.

Terminology

The terms and phrases as indicated in quotes (" ") in this section are intended to have the meaning ascribed to them in this Terminology section applied to them throughout this document, including the claims, unless clearly indicated otherwise in context. Further, as applicable, the stated definitions are to apply, regardless of the word or phrase's case, to the singular and plural variations of the defined word or phrase.

The term "or", as used in this specification and the appended claims, is not meant to be exclusive; rather, the term is inclusive, meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of the phrase "in one embodiment" and/or "in one variation" in various places in the specification are not necessarily all meant to refer to the same embodiment.

The term "couple" or "coupled", as used in this specification and the appended claims, refers to either an indirect or a direct connection between the identified elements, components, or objects. Often, the manner of the coupling will be related specifically to the manner in which the two coupled elements interact.

The term "removable", "removably coupled", "readily removable", "readily detachable", "detachably coupled", and similar terms, as used in this patent application specification (including the claims and drawings), refer to structures that can be uncoupled from an adjoining structure with relative ease (i.e., non-destructively, and without a complicated or time-consuming process) and that can also be readily reattached or coupled to the previously adjoining structure.

Directional and/or relational terms such as, but not limited to, left, right, nadir, apex, top, bottom, vertical, horizontal, back, front, and lateral are relative to each other, are dependent on the specific orientation of an applicable element or article, are used accordingly to aid in the description of the various embodiments in this specification and the appended claims, and are not necessarily intended to be construed as limiting.

As applicable, the terms "about" or "generally", as used herein in the specification and appended claims, and unless otherwise indicated, means a margin of +−20%. Also, as applicable, the term "substantially" as used herein in the specification and appended claims, unless otherwise indicated, means a margin of +−10%. It is to be appreciated that not all uses of the above terms are quantifiable such that the referenced ranges can be applied.

First Embodiment

A Multi-Directional Momentum-Change Sensor

This embodiment is generally directed to a multi-directional momentum-change sensor, adaptable to a variety of practical applications, including, but not limited to, its use as a collision-detector for automatic passenger-safety airbag deployment systems in a motor vehicle.

Figure 2:
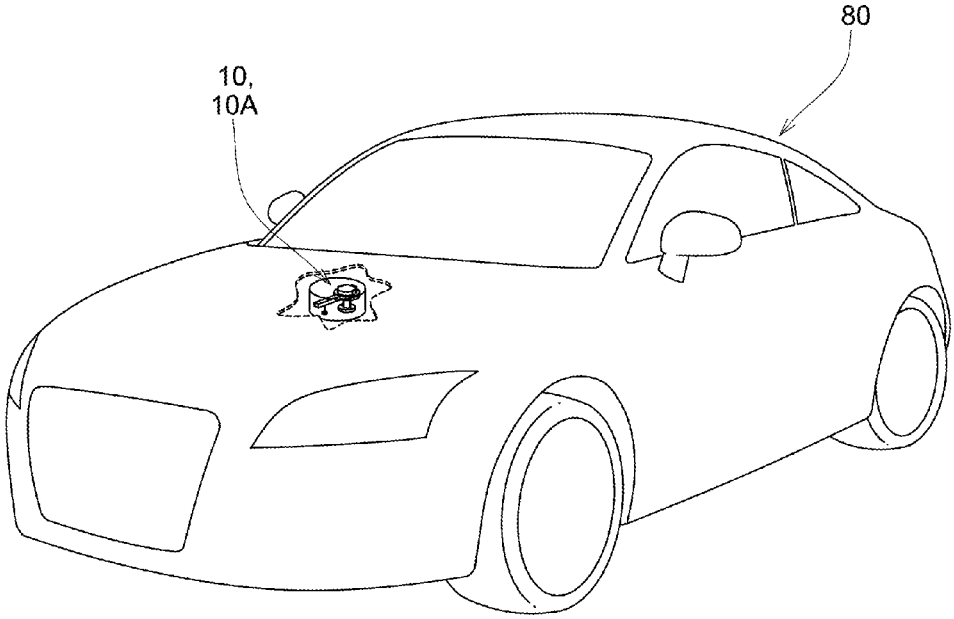
FIG. 2 depicts one embodiment of the use of a multi-directional momentum-change sensor within a motor vehicle, with the sensor contained in an enclosure and disposed approximately within the dashboard or the engine compartment of the motor vehicle.

Refer to FIGS. 1A-2. In an embodiment, the sensor 10 comprises a base member 70 adapted to be able to be fixedly mounted to a surface. Fixedly coupled to that base member 70 is a column member 15 having a first end and a second end, wherein the first end is coupled to the base member 15.

In variations, the column member 15 is adapted to fixedly couple to a substantially discoid electrical-contact-array assembly 20, having a first end and a second end, and having a plurality of electrical-contact surfaces 20A, 20B, 20C disposed radially about the outer surface of the discoid member 20, wherein the first end of the electrical-contact-array assembly 20 is fixedly coupled to the second end of the column member 15.

In some variations, the rotatable inertial switching assembly 30 comprises a pivotable boom member 35, having a proximal end and a distal end, the proximal end being the end closest to the substantially discoid electrical-contact-array assembly 20. In some variations, the pivotable boom member 35 has a longitudinally disposed channel, with an electrical contact 25 fixedly disposed at the proximal end of the boom member 35. In still more variations, a electrically conductive spring member 40, configured to resist extension, and having a first end and a second end, is fixedly coupled on its one end at or near the proximal end of the pivotable boom member 35 and electrically coupled to the proximal-end contact 25, the spring member 40 adapted to be able to be extendable to a length of at least approximately equal to that of the longitudinally disposed channel when predetermined stretching force is applied. In addition, in variations, a weighted, slidable electrical contact 45 is fixedly coupled to the second (distal) end of the spring member 40. The weighted, slidable contact 45 is adapted to be movable along the longitudinal channel of the pivotable boom member 35, and electrically in continuous communication with the proximal-end electrical contact 25. Further, in other variations, a distal-end electrical contact 50 is fixedly disposed at the end of the longitudinally disposed channel at the distal end of the boom member 35, with the distal-end electrical contact 50 positioned such that the weighted, slidable electrical contact 45 can electrically couple with the distal-end contact 50 when the spring member 40 is extended. It should be noted that in many variations, the shape of the weighted, slidable contact 45 can vary; e.g., a substantially spherical member, a block-shaped member, an ovoid-shaped member, etc.; so long as its shape and material allows for freedom of movement along the longitudinal channel and so long as the shape of the member can successfully make electrical contact with the distal-end contact 50.

In yet more variations, the longitudinal channel is configured to have an electrically conductive trace that extends from the proximal end of the boom member 35 toward the distal end; however, the conductive trace cannot extend all the way to the distal-end electrical contact 50 because the functionality of the boom member 35 relies on the weighted, slidable contact 45 to complete the conductive path between the proximal-end electrical contact 25 and the distal-end contact 50.

In many other variations, the inertial switching assembly 30 is adapted to be pivotably coupled about the longitudinal axis of the substantially discoid electrical-contact-array assembly 20. In one such variation, the column member 15 has a radially disposed bearing surface 15A, which is adapted to facilitate the rotatable mounting of an inertial switching assembly 30. In some cases, this bearing surface 15A is coated with a low-friction material, such as graphite or polytetrafluoroethylene (PTFE), in order to facilitate ease of pivoting motion.

In even more variations, the inertial switching assembly's 30 proximal-end electrical contact 25 on the boom member 35 is adapted to be able to make surface-to-surface electrical contact with at least one of the plurality of electrical-contact surfaces 20A, 20B, 20C, depending on the pivoted position of the boom member 35 relative to the substantially discoid electrical-contact-array assembly 20. It should be appreciated by one skilled in the art that in many embodiments, the spacing between the electrical-contact surfaces 20A, 20B, 20C is close enough to allow for simultaneous closing of electrical control circuits via the middle electrical-contact surface 20B and also through one of the adjacent electrical-contact surfaces 20A or 20B when an oblique force is felt above a predetermined threshold, such as when an automobile experiences a front-angled collision. In some embodiments, this electrical-contact surface-to-surface contact can be facilitated by mechanically biasing the proximal-end contact 25 to press against the electrical-contact-array assembly 20 (for example, by a spring-loaded proximal-end contact 25, with the proximal-end contact 25 surface comprised of a relatively low-friction, conductive material such as carbon/graphite).

Returning to the electrical-contact-array assembly 20, in some variations, there are three contacts in the array 20A, 20B, 20C, each one located in a position to facilitate the detection of a force felt by the sensor along a vector that is somewhat orthogonal to the outer surface of each contact 20A, 20B, 20C. In some configurations, two of the three electrical-contact surfaces 20A, 20C are disposed on opposite sides of the substantial discoid electrical-contact-array assembly 20, with respect to each other, and the third of the electrical-contact surfaces 20B is disposed between the other two electrical-contact surfaces 20A, 20C, at approximately an equal distance from each of the two other electrical-contact surfaces 20A, 20C.

In various applications of some embodiments, the effective setpoint of the sensor 10 (that is, the predetermined threshold for an applied force along a given vector) can be adjusted by changing the dimensions and/or strength of the spring member 45. In yet another variation, the inertial switching assembly's spring member 45 is coupled at or near said proximal end of the pivotable boom member 35 with an intervening threaded spring-tension adjustment device that includes an adjustment member selected from a group comprised of a screw, a nut, and/or a bolt. Such a spring-tension adjustment member effectively adjusts the amount of the spring that is available for extension during sensor 10 operations.

Another way to adjust the effective setpoint of the sensor 10 (that is, the predetermined threshold for an applied force along a given vector) is by anchoring the pivotable boom member 35 in an initial position (typically, in many embodiments, a front-facing, middle position) by way of a break-away anchoring line 60 and anchor mount 65 that is fixedly attached to an external structure/surface at a predetermined location, wherein the anchoring line 60 is adapted to sever when a predetermined force along a given vector to cause stress on said anchor line 60 (typically a lateral force), thus allowing the pivotable boom member to rotate. The centrifugal force associated with the sudden rotation will cause the weighted, slidable contact 45 to travel to the distal-end contact 50 at the end of the boom member 35. The length and diameter of the anchor line 60, the yield-point of the anchor-line material, and the location of the anchor points at each end of the anchor line 60 can affect the break-way force setpoint of the pivotable boom member 35. In some variations, the anchor line is made of a material selected from a group comprised of thin, high-tensile-strength, metal wire, hard-plastic line, and/or monofilament line.

In some configurations, the external electrical circuit connectivity via the distal-end electrical contact 50 is by way of a direct coupling to a highly flexible conductor 55 that has enough slack to not interfere with the rotational movement of the pivotable boom member 35, and allows boom-member 35 rotation along a predetermined travel distance. However, in an alternate configuration, depicted in FIG. 1D, a stationary slip-ring contact member 75 adapted to be continuously electrically, yet slidably, coupled to the distal-end electrical contact 50A on the pivotable boom member 35 as the pivotable boom member 35 pivots about the axis of the longitudinal axis of the substantially discoid electrical-contact-array assembly 20, wherein the slip-ring contact member 75 facilitates electrical coupling to external circuitry. In some variations, the slip-ring contact member is disposed radially about the column member 15, and the pivotable boom member 35 has an electrical conduit 50A disposed from the distal-end electrical contact 50 along the bottom length of the boom member 35 toward the proximal-end of the boom member 35 to a slip-ring-interface contact 50B, which rides/slides on the slip-ring contact member 75.

In one embodiment, the multi-directional momentum-change sensor 10 is adapted to be installed and operated in a motor vehicle 80, with the sensor 10 oriented to be responsive to abrupt changes in the vehicle's lateral and forward momentum beyond predetermined settings. In some variations, the sensor is equipped with its own external housing 10A to minimize the chance that the mechanical and electrical components of the sensor 10 are compromised with dirt and/or debris. In a typical variation, the distal-end electrical contact 50 on the pivotable boom member 35 and each of the electrical-contact surfaces of the substantially discoid electrical-contact-array assembly 20 are each electrically coupled to external circuitry 5A, 5B, 5C, 55 such that various path for current flow can be created when the pivotable boom member 35 is subjected to external forces such that the spring-mounted, weighted, sliding electrical contact 45 makes contact with the distal-end electrical contact 50, and the proximal-end electrical contact 25 makes contact with the electrical-contact surfaces 20A, 20B, 20C of the substantially discoid electrical-contact-array assembly 20 according to the pivoted position of the pivotable boom member 35. In further variations, the motor-vehicle-installed sensor assembly 10, 10A is communicatively coupled with external circuitry in order to sense a collision of a motor vehicle by sudden changes in lateral and/or forward momentum, beyond a predetermined value, and actuate the deployment of air bags within the passenger compartment of the motor vehicle 80.

In even more variations, the multi-directional momentum-change sensor 10, 10A is adapted to be installed and operated in a motor vehicle 80 of a type selected from a group comprised of passenger sedan, sport-utility vehicle, pick-up truck, van, mini-van, heavy-duty truck, motor-home, and/or semi-tractor.

Finally, in yet another variation, the motor-vehicle-installed sensor 10, 10A is configured to deploy passenger-safety airbags in the event of frontal and/or near-frontal collisions more severe than a threshold defined by the regulations governing vehicle construction in whatever particular market the motor vehicle 80 is intended for. In one variation, the prescribed airbag deployment occurs for collision forces resulting in sudden deceleration of at least equivalent to that of a 23 km/h (14 mph) barrier collision.

Second Embodiment

A Method of Making a Multi-Directional Momentum-Change Sensor

This embodiment is generally directed to making a multi-directional momentum-change sensor, adaptable to a variety of practical applications, including, but not limited to, its use as a collision-detector for automatic passenger-safety airbag deployment systems in a motor vehicle.

Refer to FIGS. 1A-2. In an embodiment, the method comprises the steps of:

- Providing a base member 70 adapted to be able to be fixedly mounted to a surface;
- Providing a column member 15, having a first end and a second end, wherein the first end is fixedly coupled to the base member 70;
- Providing a substantially discoid electrical-contact-array assembly 20, having a first end and a second end, and having a plurality of electrical-contact surfaces 20A, 20B, 20C disposed radially about the outer surface of the substantially discoid assembly 20, wherein the first end is fixedly coupled to the second end of the column member 15; and
- Providing an inertial switching assembly 30, comprising:
  - A pivotable boom member 35, having a proximal end and a distal end, the proximal end being the end closest to said substantially discoid electrical-contact-array assembly 20, and having a longitudinally disposed channel,
  - An electrical contact 25 fixedly disposed at the proximal end of the boom member 35,
  - An spring member 40 configured to resist extension, having a first end and a second end, fixedly coupled on its first end at or near said proximal end of the pivotable boom member 35, the spring member 40 adapted to be able to be extendable to a length of at least approximately equal to that of the longitudinally disposed channel when predetermined stretching force is applied,
  - A weighted, sliding electrical contact 45, fixedly coupled to the second end of the spring member 40, adapted to be movable along the longitudinal channel, and electrically in continuous communication with the proximal-end electrical contact 25, and
  - A distal-end electrical contact 50 fixedly disposed at the end of the longitudinally disposed channel, at the distal end of the boom member 35, the distal-end electrical contact 50 positioned such that the weighted, sliding electrical contact 45 can electrically couple with the distal-end contact 50 when the spring member 40 is extended;

Wherein the inertial switching assembly 30 is adapted to be pivotably coupled about the longitudinal axis of the substantially discoid electrical-contact-array assembly 20; and Wherein the inertial switching assembly's proximal-end electrical contact 25 on the boom member 35 is adapted to make surface-to-surface electrical contact with at least one of the plurality of electrical-contact surfaces 20A, 20B, 20C, depending on the pivoted position of the boom member relative to the substantially discoid electrical-contact-array assembly 20.

This embodiment can be enhanced wherein the discoid electrical-contact-array assembly 20 electrical-contact surface-to-surface contact can be facilitated by mechanically biasing the proximal-end contact 25 to press against the electrical-contact-array assembly 20 (for example, by a spring-loaded proximal-end contact 25, with the proximal-end contact 25 surface comprised of a relatively low-friction, conductive material such as carbon/graphite).

This embodiment can be enhanced wherein the weighted, sliding electrical contact 45 is selected from a group comprised of a substantially spherical member, a block-shaped member, and/or an ovoid-shaped member. It should be noted that in many variations, the shape of the weighted, slidable contact 45 can vary; e.g., a substantially spherical member, a block-shaped member, an ovoid-shaped member, etc.; so long as its shape and material allows for freedom of movement along the longitudinal channel and so long as the shape of the member can successfully make electrical contact with the distal-end contact 50.

This embodiment can be enhanced wherein the longitudinal channel is configured to have an electrically conductive trace that extends from the proximal end of the boom member 35 toward the distal end; however, the conductive trace cannot extend all the way to the distal-end electrical contact 50 because the functionality of the boom member 35 relies on the weighted, slidable contact 45 to complete the conductive path between the proximal-end electrical contact 25 and the distal-end contact 50.

This embodiment can be enhanced wherein the inertial switching assembly 30 is adapted to be pivotably coupled about the longitudinal axis of the substantially discoid electrical-contact-array assembly 20. In one such variation, the column member 15 has a radially disposed bearing surface 15A, which is adapted to facilitate the rotatable mounting of an inertial switching assembly 30. In some cases, this bearing surface 15A is coated with a low-friction material, such as graphite or polytetrafluoroethylene (PTFE), in order to facilitate ease of pivoting motion.

This embodiment can be enhanced wherein the electrical-contact-array assembly 20 has three electrical-contact surfaces 20A, 20B, 20C, and wherein two of the electrical-contact surfaces 20A, 20C are disposed on opposite sides of the substantial discoid member, with respect to each other, and the third 20B of the electrical-contact surfaces is disposed between the other two electrical-contact surfaces 20A, 20C, at approximately an equal distance from the third electrical-contact surface 20B to each of the two other electrical-contact surfaces 20A, 20C.

This embodiment can be enhanced by further comprising the step of providing a break-away boom-anchor line 60 with a first end and a second end, wherein the first end fixedly is attached to said pivotable boom member 35, and wherein the second end is adapted to be fixedly attached to an external structure via an anchor mount 65, and wherein the boom-anchor line 60 is calibrated to break when subjected to a predetermined stress force. In further variations, this embodiment can be enhanced wherein the pivotable boom member 35 is fixed in a predetermined position by the break-away boom-anchor line 60. In some variations, the anchor line 60 is made of a material selected from a group comprised of thin, high-tensile-strength, metal wire, hard-plastic line, and/or monofilament line.

This embodiment can be enhanced wherein the sensor 10 is adapted to be installed in a motor vehicle 80, the sensor 10 oriented to be responsive to abrupt changes in said vehicle's lateral and forward momentum beyond predetermined settings; and wherein the distal-end electrical contact 50 on the pivotable boom member 35 and each of the electrical-contact surfaces 20A, 20B, 20C of the substantially discoid electrical-contact-array assembly 20 is electrically coupled to external circuitry 5A, 5B, 5C, 55 such that various path for current flow can be created when the pivotable boom member 35 is subjected to external forces such that the spring-mounted, weighted, sliding electrical contact 45 makes contact with the distal-end electrical contact 50, and the proximal-end electrical contact 25 makes contact with the electrical-contact surfaces 20A, 20B, 20C of the substantially discoid electrical-contact-array assembly 20 according to the pivoted position of the pivotable boom member 35.

This embodiment can be enhanced by further comprising the step of providing a stationary slip-ring contact member 75 adapted to be continuously electrically and slidably coupled to the distal-end electrical contact on the pivotable boom member as the pivotable boom member 35 pivots about the axis of the longitudinal axis of said substantially discoid electrical-contact-array assembly 20, wherein the slip-ring contact member 75 facilitates electrical coupling to external circuitry 55. In some variations, the slip-ring contact member 75 is disposed radially about the column member 15, and the pivotable boom member 35 has an electrical conduit 50A disposed from the distal-end electrical contact 50 along the bottom length of the boom member 35 toward the proximal-end of the boom member 35 to a slip-ring-interface contact 50B, which rides/slides on the slip-ring contact member 75.

This embodiment can be enhanced wherein instead of electrically connecting to a slip-ring assembly 75, the distal-end electrical contact 50 on the pivotable boom member 35 is directly coupled to a flexible electrical conduit 55 to facilitate electrical coupling to external circuitry, and wherein the flexible electrical conduit 55 has enough slack to allow the pivotable boom member 35 to rotate along a predetermined travel distance.

This embodiment can be enhanced wherein the external circuitry is configured to sense a collision of a motor vehicle 80 by sudden changes in lateral and/or forward momentum, beyond a predetermined value, and actuate the deployment of air bags within the passenger compartment of the motor vehicle 80.

This embodiment can be enhanced wherein the sensor 10 is adapted to be installed within an enclosure 10A and operated in a motor vehicle 80 of a type selected from a group comprised of passenger sedan, sport-utility vehicle, pick-up truck, van, mini-van, heavy-duty truck, motor-home, semi-tractor, aircraft, and/or water craft.

This embodiment can be enhanced wherein the motor-vehicle-installed sensor 10, 10A is configured to deploy passenger-safety airbags in the event of frontal and/or near-frontal collisions more severe than a threshold defined by the regulations governing vehicle construction in whatever particular market the motor vehicle 80 is intended for. In one variation, the prescribed airbag deployment occurs for collision forces resulting in sudden deceleration of at least equivalent to that of a 23 km/h (14 mph) barrier collision.

Third Embodiment

A Motor Vehicle Equipped With a Multi-Directional Momentum-Change Sensor in Support of a Passenger-Safety Airbag System This embodiment is generally directed to a motor vehicle equipped with a making a multi-directional momentum-change sensor in support of a passenger-safety airbag system, the air bag system configured to deploy upon a collision with the motor vehicle that exceeds a predetermined direction and force.

Refer to FIGS. 1A-2. The motor vehicle is comprised of a multi-directional momentum-change sensor according the First Embodiment, described supra.

This embodiment can be enhanced wherein the sensor 10, 10A is adapted to be installed and operated in a motor vehicle of a type selected from a group comprised of passenger sedan, sport-utility vehicle, pick-up truck, van, mini-van, heavy-duty truck, motor-home, semi-tractor, aircraft, and/or water craft.

This embodiment can be enhanced wherein the motor-vehicle-installed sensor 10, 10A is configured to deploy passenger-safety airbags in the event of frontal and/or near-frontal collisions more severe than a threshold defined by the regulations governing vehicle construction in whatever particular market the motor vehicle 80 is intended for. In one variation, the prescribed airbag deployment occurs for collision forces resulting in sudden deceleration of at least equivalent to that of a 23 km/h (14 mph) barrier collision.

Fourth Embodiment

A Method of Making a Motor Vehicle Equipped With a Multi-Directional Momentum-Change Sensor in Support of a Passenger-Safety Airbag System This embodiment is generally directed to a method of making motor vehicle equipped with a making a multi-directional momentum-change sensor in support of a passenger-safety airbag system, the air bag system configured to deploy upon a collision with the motor vehicle that exceeds a predetermined direction and force.

Refer to FIGS. 1A-2. The method comprises the steps of installing in a motor vehicle 80 a multi-directional momentum-change sensor 10, 10A that has been made according the Second Embodiment, described supra.

This embodiment can be enhanced wherein the sensor is adapted to be installed and operated in a motor vehicle of a type selected from a group comprised of passenger sedan, sport-utility vehicle, pick-up truck, van, mini-van, heavy-duty truck, motor-home, semi-tractor, aircraft, and/or water craft.

This embodiment can be enhanced wherein the motor-vehicle-installed sensor 10, 10A is configured to deploy passenger-safety airbags in the event of frontal and/or near-frontal collisions more severe than a threshold defined by the regulations governing vehicle construction in whatever particular market the motor vehicle 80 is intended for. In one variation, the prescribed airbag deployment occurs for collision forces resulting in sudden deceleration of at least equivalent to that of a 23 km/h (14 mph) barrier collision.

Fifth Embodiment

A Method of Using a Multi-Directional Momentum-Change

This embodiment is generally directed to a method of using a multi-directional momentum-change sensor. Refer to FIGS. 1A-2. The method comprises the steps of:

Obtaining a multi-directional momentum-change sensor 10, 10A according to the First Embodiment, described supra; and Fixedly mounting and electrically coupling the multi-directional momentum-change sensor 10, 10A in a motor vehicle 80, orienting the sensor such that its pivotable boom member 35 is respondent to sudden changes in forward momentum, as well as to changes in lateral momentum, wherein the sensor 10, 10A is adapted to close paths of electrical current flow that correspond to directional forces felt by the vehicle 80 that exceed predetermined threshold levels; and Operating said motor vehicle 80 in a traveling mode.

This embodiment can be enhanced wherein the sensor 10, 10A is adapted to be installed and operated in a motor vehicle 80 of a type selected from a group comprised of passenger sedan, sport-utility vehicle, pick-up truck, van, mini-van, heavy-duty truck, motor-home, semi-tractor, aircraft, and/or water craft.

This embodiment can be enhanced wherein the motor-vehicle-installed sensor 10, 10A is configured to deploy passenger-safety airbags in the event of frontal and/or near-frontal collisions more severe than a threshold defined by the regulations governing vehicle construction in whatever particular market the motor vehicle 80 is intended for. In one variation, the prescribed airbag deployment occurs for collision forces resulting in sudden deceleration of at least equivalent to that of a 23 km/h (14 mph) barrier collision.

Alternative Embodiments and Other Variations

The various embodiments and variations thereof described herein and/or illustrated in the accompanying claims and figures are merely exemplary and are not meant to limit the scope of the inventive disclosure. It should be appreciated that numerous variations of the invention have been contemplated as would be obvious to one of ordinary skill in the art with the benefit of this disclosure.

Hence, those ordinarily skilled in the art will have no difficulty devising a myriad of obvious variations and improvements to the invention, all of which are intended to be encompassed within the scope of the claims which follow.

What is claimed is:

1. A multi-directional momentum-change sensor, comprising:

a base member adapted to be able to be fixedly mounted to a surface;

a column member, having a first end and a second end, wherein said first end is fixedly coupled to said base member;

a substantially discoid electrical-contact-array assembly, having a first end and a second end, and having a plurality of electrical-contact surfaces disposed radially about the outer surface of the substantially discoid assembly, wherein said first end is fixedly coupled to said second end of said column member; and an inertial switching assembly, comprising:

a pivotable boom member, having a proximal end and a distal end, said proximal end being the end closest to said substantially discoid electrical-contact-array assembly, and having a longitudinally disposed channel, an electrical contact fixedly disposed at said proximal end of said boom member, an spring member configured to resist extension, having a first end and a second end, fixedly coupled on its first end at or near said proximal end of said pivotable boom member, said spring member adapted to be able to be extendable to a length of at least approximately equal to that of said longitudinally disposed channel when predetermined stretching force is applied, a weighted, sliding electrical contact, fixedly coupled to said second end of said spring member, adapted to be movable along said longitudinal channel, and electrically in continuous communication with said proximal-end electrical contact, and a distal-end electrical contact fixedly disposed at the end of said longitudinally disposed channel, at said distal end of said boom member, said distal-end electrical contact positioned such that said weighted, sliding electrical contact can electrically couple with said distal-end contact when said spring member is extended;

wherein said inertial switching assembly is adapted to be pivotably coupled about the longitudinal axis of said substantially discoid electrical-contact-array assembly; and wherein said inertial switching assembly's proximal-end electrical contact on said boom member is adapted to make surface-to-surface electrical contact with at least one of said plurality of electrical-contact surfaces, depending on the pivoted position of said boom member relative to said substantially discoid electrical-contact-array assembly.

2. The multi-directional momentum-change sensor of claim 1, wherein said weighted, sliding electrical contact is selected from the group comprising a substantially spherical member, a block-shaped member, and an ovoid-shaped member.

3. The multi-directional momentum-change sensor of claim 1, wherein:

said electrical-contact-array assembly has three electrical-contact surfaces; and two of said electrical-contact surfaces are disposed on opposite sides of said substantial discoid member, with respect to each other, and the third of said electrical-contact surfaces is disposed between the other two electrical-contact surfaces, at approximately an equal distance from said third electrical-contact surface to each of the two other electrical-contact surfaces.

4. The multi-directional momentum-change sensor of claim 3, wherein:

said sensor is adapted to be installed and operated in a motor vehicle, said sensor oriented to be responsive to abrupt changes in said vehicle's lateral and forward momentum beyond predetermined settings; and said distal-end electrical contact on said pivotable boom member and each of said electrical-contact surfaces of said substantially discoid electrical-contact-array assembly is electrically coupled to external circuitry such that various path for current flow can be created when said pivotable boom member is subjected to external forces such that said spring-mounted, weighted, sliding electrical contact makes contact with said distal-end electrical contact, and said proximal-end electrical contact makes contact with the electrical-contact surfaces of said substantially discoid electrical-contact-array assembly according to the pivoted position of said pivotable boom member.

5. The multi-directional momentum-change sensor of claim 4, further comprising a stationary slip-ring contact member adapted to be continuously electrically and slidably coupled to said distal-end electrical contact on said pivotable boom member as said pivotable boom member pivots about the axis of said longitudinal axis of said substantially discoid electrical-contact-array assembly, wherein said slip-ring contact member facilitates electrical coupling to external circuitry.

6. The multi-directional momentum-change sensor of claim 4, wherein:

said distal-end electrical contact on said pivotable boom member is directly coupled to a flexible electrical conduit to facilitate electrical coupling to external circuitry; and said flexible electrical conduit has enough slack to allow said pivotable boom member to rotate along a predetermined travel distance.

7. The multi-directional momentum-change sensor of claim 4, wherein said external circuitry is configured to sense a collision of a motor vehicle by sudden changes in lateral and/or forward momentum, beyond a predetermined value, and actuate the deployment of at least one air bag within the passenger compartment of said motor vehicle.

8. The multi-directional momentum-change sensor of claim 4, wherein said sensor is adapted to be installed and operated in a motor vehicle of a type selected from the group consisting of passenger sedan, sport-utility vehicle, pick-up truck, van, mini-van, heavy-duty truck, motor-home, semi-tractor, aircraft, and water craft.

9. The multi-directional momentum-change sensor of claim 1, further comprising a break-away boom-anchor line with a first end and a second end, wherein:

said first end fixedly is attached to said pivotable boom member, said second end is adapted to be fixedly attached to an external structure, and said boom-anchor line is calibrated to break when subjected to a predetermined stress force.

10. The multi-directional momentum-change sensor of claim 9, wherein said pivotable boom member is fixed in a predetermined position by said break-away boom-anchor line.

11. A method of using a multi-directional momentum-change sensor, comprising:

obtaining a multi-directional momentum-change sensor according to claim 1;

fixedly mounting and electrically coupling said multi-directional momentum-change sensor in a motor vehicle, orienting said sensor such that its pivotable boom member is respondent to sudden changes in forward momentum, as well as to changes in lateral momentum, wherein said sensor is adapted to close paths of electrical current flow that correspond to directional forces felt by said vehicle that exceed predetermined threshold levels; and operating said motor vehicle in a traveling mode.

12. The method of claim 11, wherein said motor vehicle is of a type selected from the group consisting of passenger sedan, sport-utility vehicle, pick-up truck, van, mini-van, heavy-duty truck, motor-home, semi-tractor, aircraft, and water craft.

13. A method of making a multi-directional momentum-change sensor, comprising:

providing a base member adapted to be able to be fixedly mounted to a surface;

providing a column member, having a first end and a second end, wherein said first end is fixedly coupled to said base member;

providing a substantially discoid electrical-contact-array assembly, having a first end and a second end, and having a plurality of electrical-contact surfaces disposed radially about the outer surface of the substantially discoid assembly, wherein said first end is fixedly coupled to said second end of said column member; and providing an inertial switching assembly, comprising:

a pivotable boom member, having a proximal end and a distal end, said proximal end being the end closest to said substantially discoid electrical-contact-array assembly, and having a longitudinally disposed channel, an electrical contact fixedly disposed at said proximal end of said boom member, an spring member configured to resist extension, having a first end and a second end, fixedly coupled on its first end at or near said proximal end of said pivotable boom member, said spring member adapted to be able to be extendable to a length of at least approximately equal to that of said longitudinally disposed channel when predetermined stretching force is applied, a weighted, sliding electrical contact, fixedly coupled to said second end of said spring member, adapted to be movable along said longitudinal channel, and electrically in continuous communication with said proximal-end electrical contact, and a distal-end electrical contact fixedly disposed at the end of said longitudinally disposed channel, at said distal end of said boom member, said distal-end electrical contact positioned such that said weighted, sliding electrical contact can electrically couple with said distal-end contact when said spring member is extended;

wherein said inertial switching assembly is adapted to be pivotably coupled about the longitudinal axis of said substantially discoid electrical-contact-array assembly; and wherein said inertial switching assembly's proximal-end electrical contact on said boom member is adapted to make surface-to-surface electrical contact with at least one of said plurality of electrical-contact surfaces, depending on the pivoted position of said boom member relative to said substantially discoid electrical-contact-array assembly.

14. The method of claim 13, wherein:

said electrical-contact-array assembly has three electrical-contact surfaces; and two of said electrical-contact surfaces are disposed on opposite sides of said substantial discoid member, with respect to each other, and the third of said electrical-contact surfaces is disposed between the other two electrical-contact surfaces, at approximately an equal distance from said third electrical-contact surface to each of the two other electrical-contact surfaces.

15. The method of claim 13, further comprising the step of providing a break-away boom-anchor line with a first end and a second end, wherein:

said first end fixedly is attached to said pivotable boom member, said second end is adapted to be fixedly attached to an external structure, and said boom-anchor line is calibrated to break when subjected to a predetermined stress force.

16. The method of claim 15, wherein said pivotable boom member is fixed in a predetermined position by said break-away boom-anchor line.

17. A motor vehicle equipped with at least one passenger-safety inflatable air bag system, said air bag system configured to deploy upon a collision with said motor vehicle that exceeds a predetermined direction and force, the motor vehicle comprising:

multi-directional momentum-change sensor, comprising:

a base member adapted to be able to be fixedly mounted to a surface;

a column member, having a first end and a second end, wherein said first end is fixedly coupled to said base member;

a substantially discoid electrical-contact-array assembly, having a first end and a second end, and having a plurality of electrical-contact surfaces disposed radially about the outer surface of the substantially discoid assembly, wherein said first end is fixedly coupled to said second end of said column member; and an inertial switching assembly, comprising:

a pivotable boom member, having a proximal end and a distal end, said proximal end being the end closest to said substantially discoid electrical-contact-array assembly, and having a longitudinally disposed channel, an electrical contact fixedly disposed at said proximal end of said boom member, an spring member configured to resist extension, having a first end and a second end, fixedly coupled on its one end at or near said proximal end of said pivotable boom member, said spring member adapted to be able to be extendable to a length of at least approximately equal to that of said longitudinally disposed channel when predetermined stretching force is applied, a weighted, sliding electrical contact, fixedly coupled to said distal end of said spring member, adapted to be movable along said longitudinal channel, and electrically in continuous communication with said proximal-end electrical contact, and a distal-end electrical contact fixedly disposed at the end of said longitudinally disposed channel, at said distal end of said boom member, said distal-end electrical contact positioned such that said weighted, sliding electrical contact can electrically couple with said distal-end contact when said spring member is extended;

wherein said inertial switching assembly is adapted to be pivotably coupled about the longitudinal axis of said substantially discoid electrical-contact-array assembly; and wherein said inertial switching assembly's proximal-end electrical contact on said boom member is adapted to make surface-to-surface electrical contact with at least one of said plurality of electrical-contact surfaces, depending on the pivoted position of said boom member relative to said substantially discoid electrical-contact-array assembly.

18. The motor vehicle of claim 17, wherein:

said electrical-contact-array assembly has three electrical-contact surfaces; and two of said electrical-contact surfaces are disposed on opposite sides of said substantial discoid member, with respect to each other, and the third of said electrical-contact surfaces is disposed between the other two electrical-contact surfaces, at approximately an equal distance from said third electrical-contact surface to each of the two other electrical-contact surfaces.

19. The motor vehicle of claim 17, further comprising a break-away boom-anchor line with a first end and a second end, wherein:

said first end fixedly is attached to said pivotable boom member, said second end is adapted to be fixedly attached to an external structure, and said boom-anchor line is calibrated to break when subjected to a predetermined stress force.

20. The motor vehicle of claim 19, wherein said predetermined stress force is associated with collision forces resulting in sudden motor-vehicle deceleration of at least equivalent to that of a 23 km/h (14 mph) barrier collision.

* * * * *